US007225724B2

(12) United States Patent
Lee

(10) Patent No.: US 7,225,724 B2
(45) Date of Patent: Jun. 5, 2007

(54) HERMETIC COMPRESSOR

(75) Inventor: Sung Ro Lee, Gwangju (KR)

(73) Assignee: Samsung Gwangju Electronics Co., Ltd., Gwangju (KR)

( * ) Notice: Subject to any disclaimer, the term of this patent is extended or adjusted under 35 U.S.C. 154(b) by 0 days.

(21) Appl. No.: 11/232,936

(22) Filed: Sep. 23, 2005

(65) Prior Publication Data

US 2006/0283322 A1 Dec. 21, 2006

(30) Foreign Application Priority Data

Jun. 16, 2005 (KR) ..... 10-2005-0051700

(51) Int. Cl.
*F01B 31/10* (2006.01)
*F04B 17/00* (2006.01)

(52) U.S. Cl. ..... 92/153; 417/415; 417/902

(58) Field of Classification Search ..... 92/140, 92/153; 184/6.6, 6.16; 417/415, 902
See application file for complete search history.

(56) References Cited

U.S. PATENT DOCUMENTS 5,554,015 A * 9/1996 Dreiman et al. ..... 417/415

FOREIGN PATENT DOCUMENTS

| | | |
|---|---|---|
| JP | 58-133490 | 8/1983 |
| JP | 4-86386 | 3/1992 |
| KR | 10-2001-0055151 A | 7/2001 |
| KR | 10-2005-0019203 A | 3/2005 |
| KR | 10-2005-0040158 | 5/2005 |

* cited by examiner

*Primary Examiner*—Michael Leslie
(74) *Attorney, Agent, or Firm*—Blank Rome LLP

(57) ABSTRACT

A hermetic compressor capable of preventing malfunction due to impurities trapped between contact portions of a crankshaft and a crankshaft supporting frame when the crankshaft rotates in a hollow portion of the frame. The hermetic compressor comprises the frame having the hollow portion, the crankshaft rotatably inserted in the hollow portion, a balance weight provided at one end of the crankshaft, and a thrust portion formed at the frame to support the crankshaft. An impurities discharge passage is formed at an outer circumferential surface of the crankshaft that comes into frictional contact with the thrust portion of the frame to guide impurities, mixed with the oil, out of the crankshaft. Correspondingly, a plurality of discharge guiding grooves is formed at the thrust portion of the frame to guide the oil and the impurities, having passed through the impurities discharge passage of the crankshaft, out of the thrust portion.

11 Claims, 9 Drawing Sheets

HERMETIC COMPRESSOR

CROSS-REFERENCE TO RELATED APPLICATION

This application claims priority from Korean Patent Application No. 2005-51700, filed on Jun. 16, 2005 in the Korean Intellectual Property Office, the disclosure of which is incorporated herein by reference.

BACKGROUND OF THE INVENTION

1. Field of the Invention

The present invention relates to a hermetic compressor and, more particularly, to a hermetic compressor capable of preventing malfunction or operation stoppage thereof by impurities trapped between contact surfaces of a crankshaft, which is mounted in the compressor to generate a driving force, and a crankshaft supporting frame.

2. Description of the Related Art

FIG. 1 is a side sectional view of a conventional hermetic compressor. As shown in FIG. 1, the hermetic compressor, that is generally employed in a refrigeration cycle of a refrigerator, air conditioner, etc., comprises a hermetic container 1 forming the outer appearance thereof, a compression unit 50 mounted in the hermetic container 1 to compress a refrigerant, and a drive unit 10 to generate a compressive force required to compress the refrigerant in the compression unit 50. The hermetic container 1 is provided at certain locations thereof with a suction tube to guide the exterior refrigerant into the hermetic container, and a discharge tube to discharge the refrigerant, compressed in the compression unit, out of the hermetic container.

Specifically, the drive unit 10 includes a crankshaft 16, a rotor 12, a stator 14, and an eccentric unit 32. The crankshaft 16 serves to transmit the driving force of the drive unit 10 to the compression unit 50 as it rotates. The rotor 12 generates a rotating force required to rotate the crankshaft 16, and the stator 14 is positioned to electromagnetically interact with the rotor 12. The eccentric unit 32 is provided at one end of the crankshaft 16 to create an eccentric motion. The eccentric unit 32 includes an eccentric shaft 28 fitted on the crankshaft 16, and a balance weight 30 to compensate the eccentric motion.

Provided in the crankshaft 16 are an internal passage 18 and an impeller 19, which are used to raise oil stored in a lower region of the hermetic container 1. A plurality of oil holes 20 and 24 are formed at an outer circumferential surface of the crankshaft 16 to be in communication with the internal passage 18. The oil holes 20 and 24 are connected to each other through an external passage 22. The external passage 22 is formed in the outer circumferential surface of the crank shaft 16 to extend in a rotating direction of the crankshaft 16.

FIG. 2 is a perspective view showing the coupling structure of the crankshaft and a supporting frame therefor. As shown in FIG. 2, the crankshaft 16 is inserted in a hollow portion of a frame 34 to be supported by a thrust portion 36 of the frame 34. The crankshaft 16 is adapted to rotate while maintaining a very minute spacing between the outer circumferential surface thereof and the thrust portion 36. During rotation of the crankshaft 16, the oil, raised from the lower region of the hermetic container 1, acts to lubricate between the crankshaft 16 and the thrust portion 36 of the frame 34.

A problem of the above-described compressor is that no passage is formed at part of the outer circumferential surface of the crankshaft 16 adjacent to the thrust portion 36 of the frame 34 and at the thrust portion 36 of the frame 34. With this configuration, even if impurities, which are mixed with the oil during lubricating operation thereof, chips created during processing of the frame 34 or the crankshaft 16, or other welding impurities, are trapped between the outer circumferential surface of the crankshaft 16 and the thrust portion 36 of the frame 34 along with the oil, the compressor is incapable of discharging them, causing stoppage in the rotating motion of the crankshaft 16. This consequently causes operation stoppage of the compressor.

SUMMARY OF THE INVENTION

Therefore, the present invention has been made in order to improve the conventional hermetic compressor as mentioned above, and it is an aspect of the invention to provide a hermetic compressor capable of effectively discharging impurities out of a crankshaft and a thrust portion of a frame during a rotating motion of the crankshaft, thereby preventing stoppage in the rotating motion of the crankshaft.

Additional aspects and/or advantages of the invention will be set forth in part in the description which follows and, in part, will be apparent from the description, or may be learned by practice of the invention.

In accordance with one aspect, the present invention provides a hermetic compressor comprising a frame having a hollow portion, a crankshaft rotatably inserted in the hollow portion, and a thrust portion formed at the frame to support the crankshaft, further comprising: an impurities discharge passage formed at an outer circumferential surface of the crankshaft adjacent to the thrust portion of the frame and adapted to guide oil and impurities mixed with the oil out of the crankshaft; and a plurality of discharge guiding grooves formed at the thrust portion of the frame at specific positions corresponding to the impurities discharge passage, and adapted to guide the oil and the impurities, having passed through the impurities discharge passage, out of the thrust portion.

The crankshaft may include a plurality of oil holes for the entrance and exit of the oil into or from the crankshaft, and an external passage to connect the oil holes to one another, and the impurities discharge passage may be separately formed with the external passage and may extend along the outer circumferential surface of the crank shaft starting from one of the plurality of oil holes to an end of the crankshaft.

The end of the crankshaft may be provided with a balance weight to balance the crankshaft when the crankshaft rotates, and the impurities discharge passage may extend from one of the plurality of oil holes closest to the balance weight to a portion of the crankshaft connected to the balance weight.

The impurities discharge passage may be formed in a straight line extending from the oil hole closest to the balance weight to the portion of the crankshaft connected to the balance weight.

The impurities discharge passage may have a spiral shape extending in a rotating direction of the crankshaft from the oil hole closest to the balance weight to an underside of the balance weight.

A horizontal cross section of the impurities discharge passage may have a conical frustum shape wherein an outer portion is wider than an inner portion.

The thrust portion of the frame may have an annular shape and is protruded from a surface of the frame, and the discharge guiding grooves of the thrust portion may extend from the hollow portion to an outer circumference of the thrust portion.

A thrust bearing may be seated between the thrust portion of the frame and the crankshaft to support the crankshaft while facilitating a rotating motion of the crankshaft, the thrust portion of the frame may have an annular shape and may be recessed from a surface of the frame by a predetermined depth to allow the thrust bearing to be seated thereon, and the discharge guiding grooves of the thrust portion may extend from the hollow portion to an outer circumference of the thrust portion.

The plurality of discharge guiding grooves, formed at the thrust portion, may be spaced apart from one another.

Each of the discharge guiding grooves of the thrust portion may have a straight line form circumferentially extending from the hollow portion to the outer circumference of the thrust portion.

Each of the discharge guiding grooves of the thrust portion may have a width equal to or larger than a width of the impurities discharge passage formed at the crankshaft to ensure smooth discharge of the impurities and the oil.

BRIEF DESCRIPTION OF THE DRAWINGS

These and/or other aspects and advantages of the invention will become apparent and more readily appreciated from the following description of the exemplary embodiments, taken in conjunction with the accompanying drawings, in which.

Figure 1:
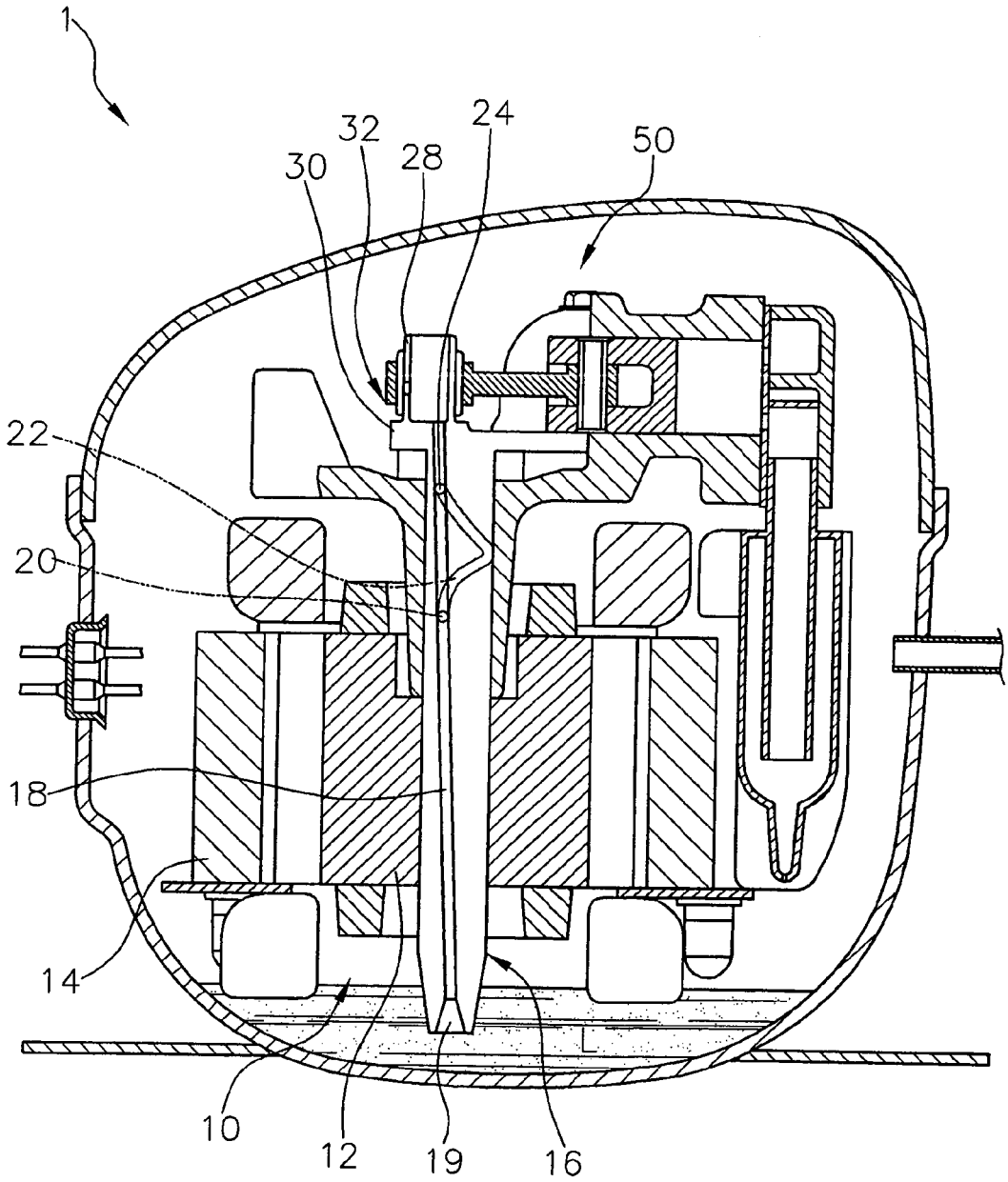
FIG. 1 (prior art)
FIG. 1 is a side sectional view of a conventional hermetic compressor.
Figure 2:
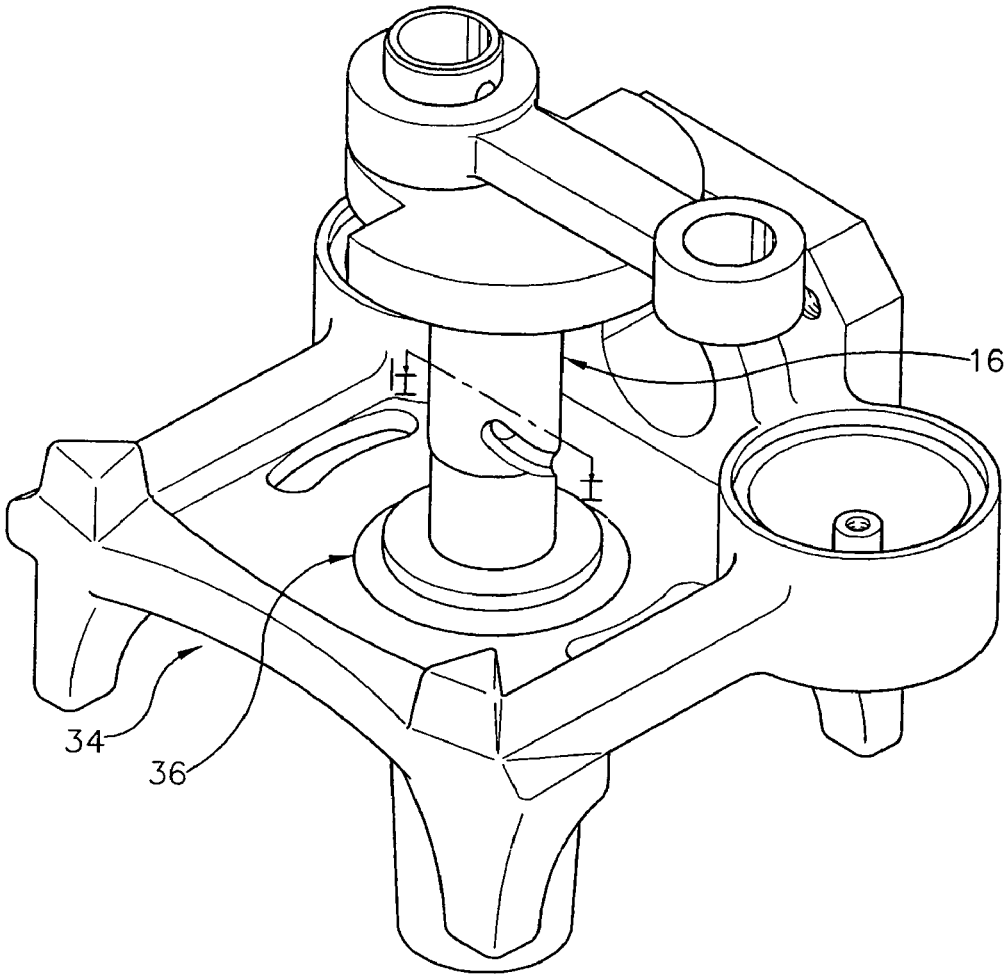
FIG. 2 (prior art)
FIG. 2 is a perspective view showing the coupling structure of a crankshaft and a frame provided in the conventional hermetic compressor.

DETAILED DESCRIPTION OF THE ILLUSTRATIVE, NONLIMITING EMBODIMENTS OF THE INVENTION

Reference will now be made in detail to the illustrative, non-limiting embodiments of the present invention, examples of which are illustrated in the accompanying drawings, wherein like reference numerals refer to like elements throughout. The exemplary embodiments are described below to explain the present invention by referring to the figures.

Figure 3:
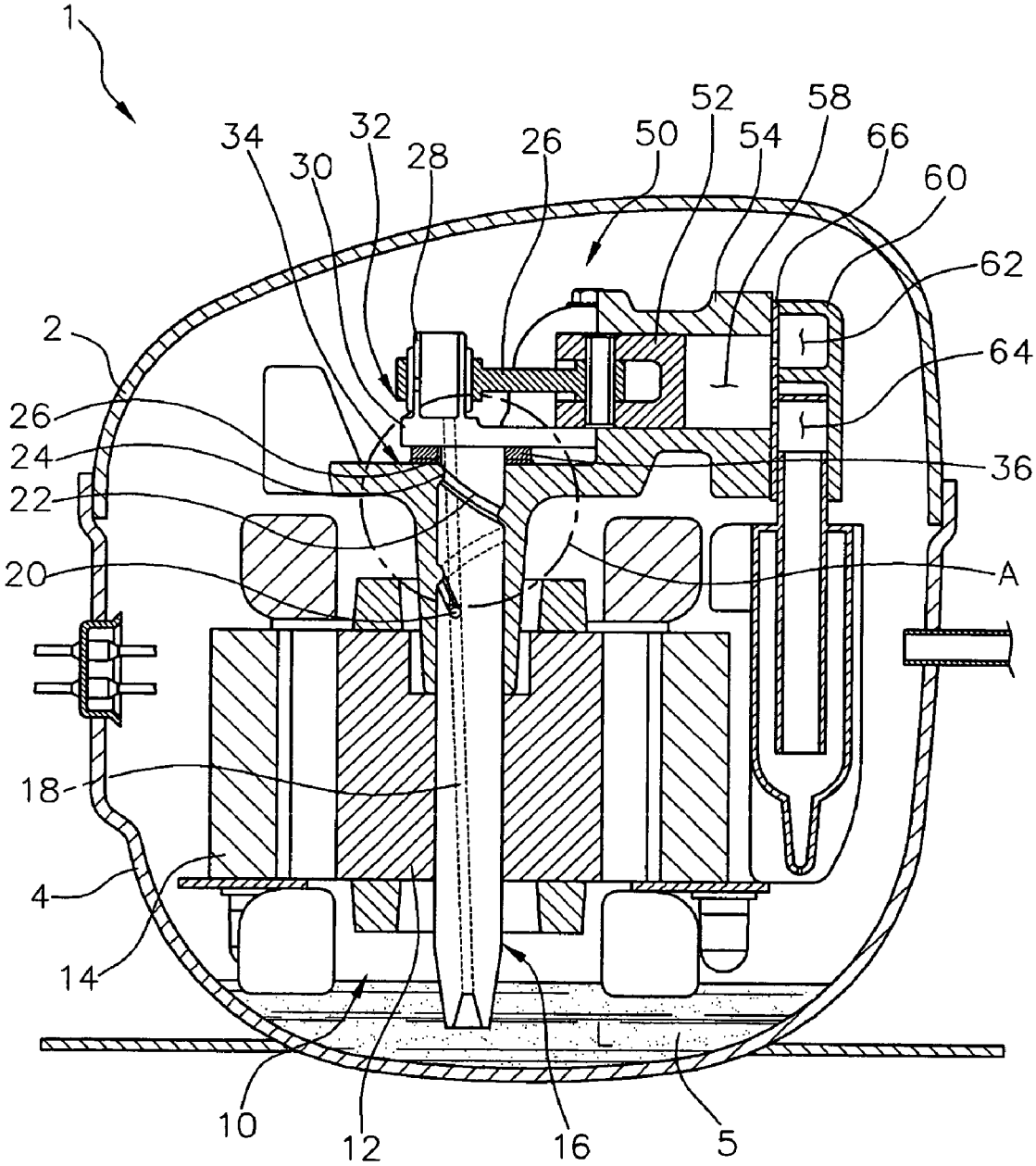
FIG. 3 is a side sectional view of a hermetic compressor consistent with the present invention.

FIG. 3 is a side sectional view of a hermetic compressor consistent with the present invention. As shown in FIG. 3, the hermetic compressor of the present invention comprises a hermetic case 1 including an upper case 2 and a lower case 4, and a compression unit 50 to compress a refrigerant and a drive unit 10 to drive the compression unit 50, which are mounted in the hermetic case 1. The compression unit 50 is internally provided with a frame 34 that supports part of the drive unit 10 and the compression unit 50. The hermetic case 1 contains oil 5 in the lower case 4 below the drive unit 10.

The compression unit 50 includes a cylinder head 60 having a discharge chamber 62 and a suction chamber 64, a cylinder block 54 coupled to the cylinder head 60 and internally defining a refrigerant compression chamber 58, and a piston 52 mounted to be reciprocated in the cylinder block 54 to compress the refrigerant.

The drive unit 10 includes a stator 14 to create a magnetic field, and a rotor 12 spaced apart from the stator 14 and adapted to electromagnetically interact with the stator 14 to perform a rotating motion. A crankshaft 16 is inserted through the center of the rotor 12, and, in turn, an eccentric unit 32 is coupled to one end of the crankshaft 16.

The eccentric unit 32 includes an eccentric shaft 28 fitted to the end of the crankshaft 16, and a balance weight 30 adapted to compensate an eccentric motion caused by the eccentric shaft 28 and to prevent lopsidedness of load during the rotating motion of the eccentric shaft 28. The eccentric shaft 28 is connected to the piston 52 through a connecting rod 56, so that a driving force of the drive unit 10 is transmitted to the piston 52 of the compression unit 50 via the connecting rod 56.

Figure 4:
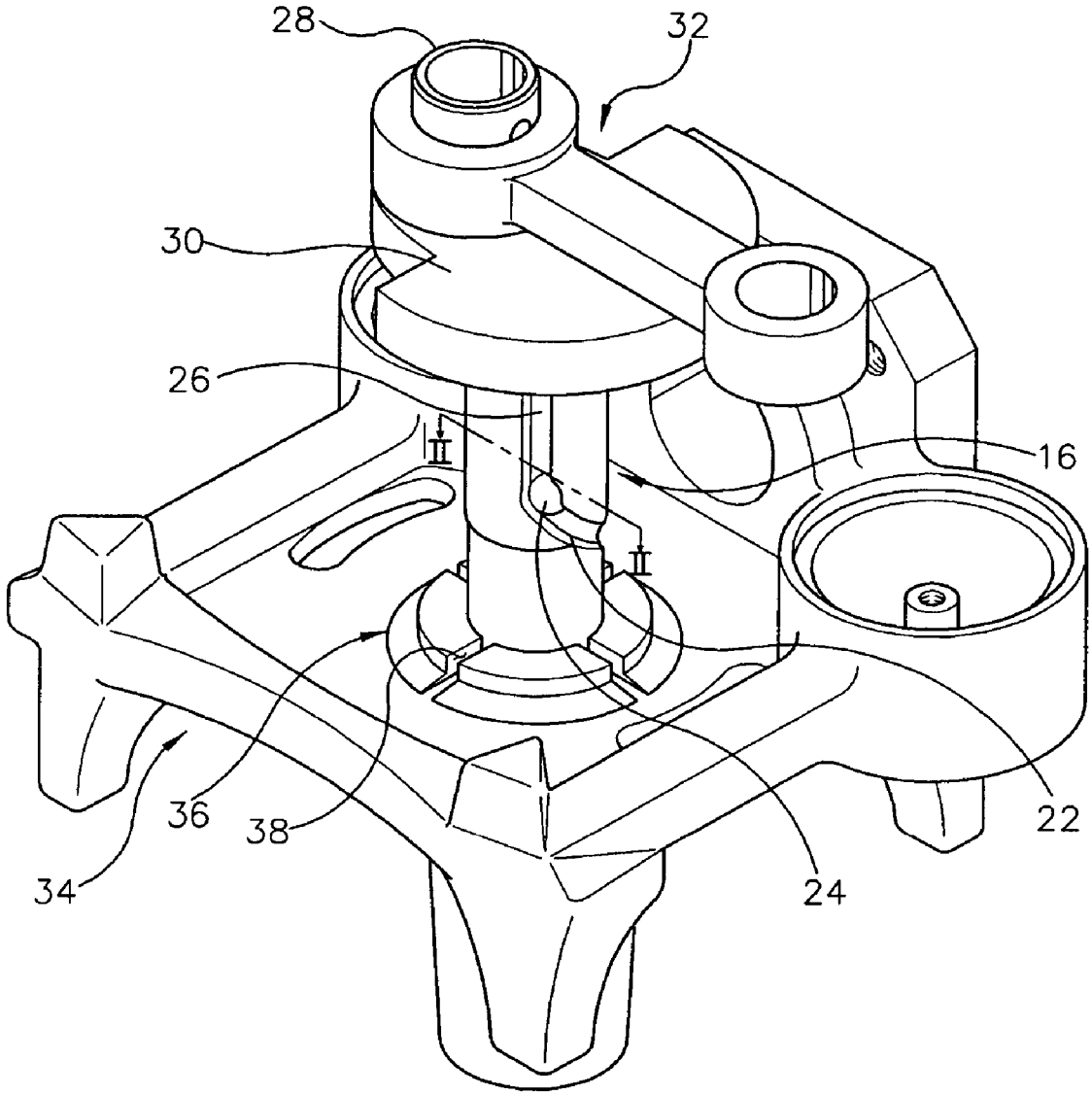
FIG. 4 is a perspective view showing the coupling structure of a frame and a crankshaft having a vertically extending impurities discharge passage consistent with the present invention.

FIG. 4 illustrates the crankshaft 16 supported by the frame 34. Specifically, a lower end of the eccentric unit 32, which is coupled to the crankshaft 16, is seated on and supported by an annular thrust portion 36 that is protruded from a surface of the frame 34.

The crankshaft 16 has an external passage 22. Thereby, the oil is able to flow along an outer circumferential surface of the crankshaft 16 in a rotating direction thereof as the crankshaft 16 rotates. An oil hole 24 is formed at an end of the external passage 22 so that the oil 5, having passed through the external passage 22, enters the interior of the crankshaft 16. The oil hole 24 is penetrated through an internal passage (not shown) of the crankshaft 16.

In an embodiment of the present invention, a vertically-extending impurities discharge passage 26, having a predetermined depth, is formed between the oil hole 24 and the balance weight 30 of the eccentric unit 32. The impurities discharge passage 26 serves to discharge impurities, such as dust contained in the oil and chips created during processing of the crankshaft 16 or the frame 34, out of the crankshaft 16.

Also, a plurality of discharge guiding grooves 38 is formed at the thrust portion 36 of the frame 34 to correspond to the impurities discharge passage 26. With this configuration, the impurities first flow along the impurities discharge passage 26 of the crankshaft 16 along with the oil, and then are discharged out of the thrust portion 36 through the discharge guiding grooves 38 positioned to correspond to the impurities discharge passage 26.

As can be seen from FIG. 4, in the embodiment of the present invention, four discharge guiding grooves 38 are equally spaced apart from one another to have a crisscross shape, so that the impurities, having passed through the impurities discharge passage 26, is immediately directed into the discharge guiding grooves 38 as the crankshaft 16 rotates, thereby being finally discharged out of the thrust portion 36.

Figure 5:
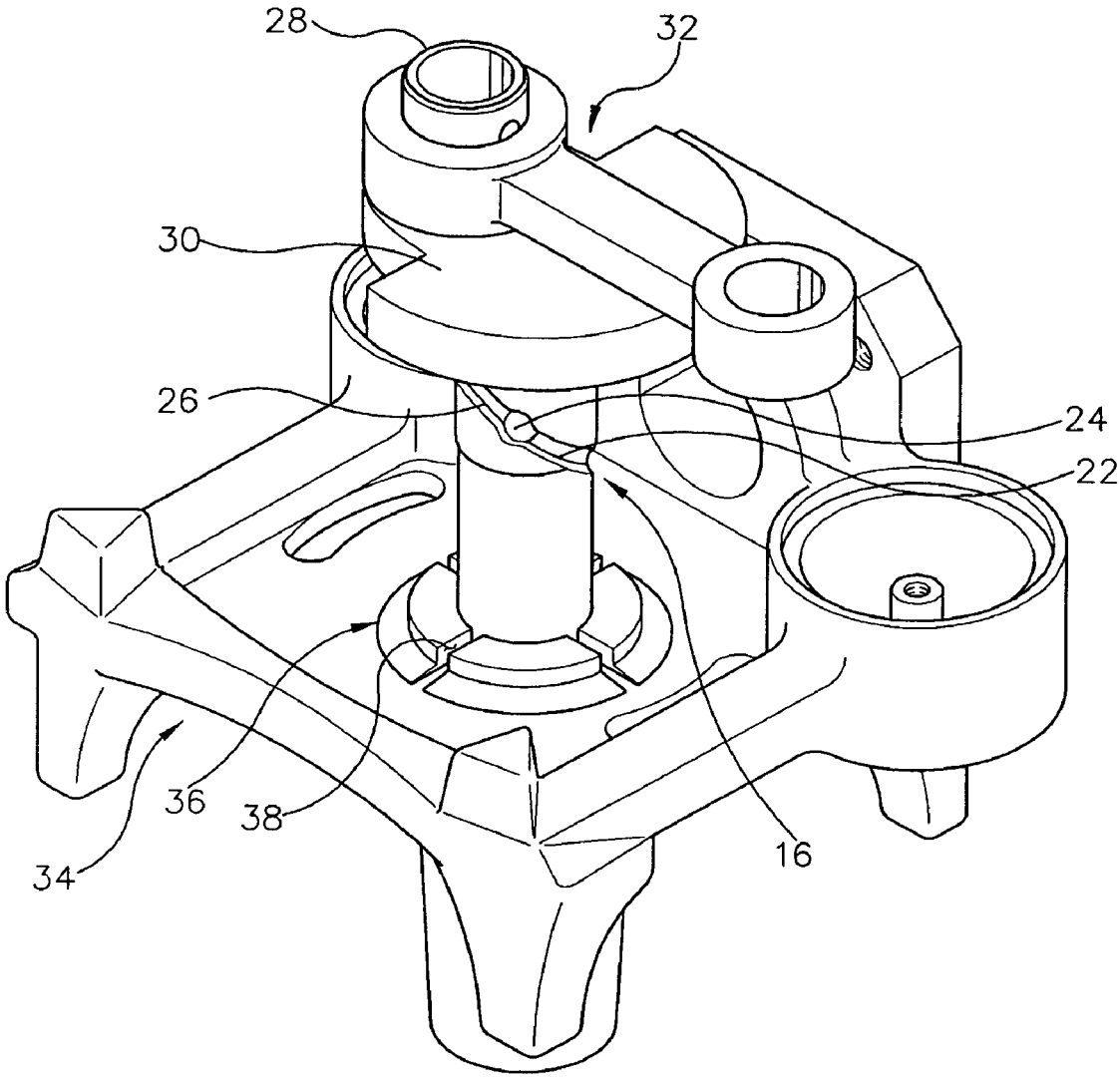
FIG. 5 is a perspective view showing the coupling structure of a frame and a crankshaft having a spiral impurities discharge passage consistent with the present invention.

FIG. 5 illustrates another impurities discharge passage consistent with the present invention. As shown in FIG. 5, the present embodiment is identical to the above described embodiment shown in FIG. 4 except that the impurities discharge passage 26 has a spiral shape to extend in the rotating direction of the crankshaft 16, rather than the vertical shape.

In the present embodiment, the impurities discharge passage 26 is on an extension line of the external passage 22. With this arrangement, the impurities, having passed through the external passage 22, are immediately introduced into the impurities discharge passage 26 by passing over the oil hole 24 while maintaining its flow direction under the influence of flow inertia, rather than entering the oil hole 24. Then, the impurities, introduced into the impurities discharge passage 26, are discharged to the outside under the guidance of the discharge guiding grooves 38 formed at the thrust portion 36 of the frame 34.

Figure 6:
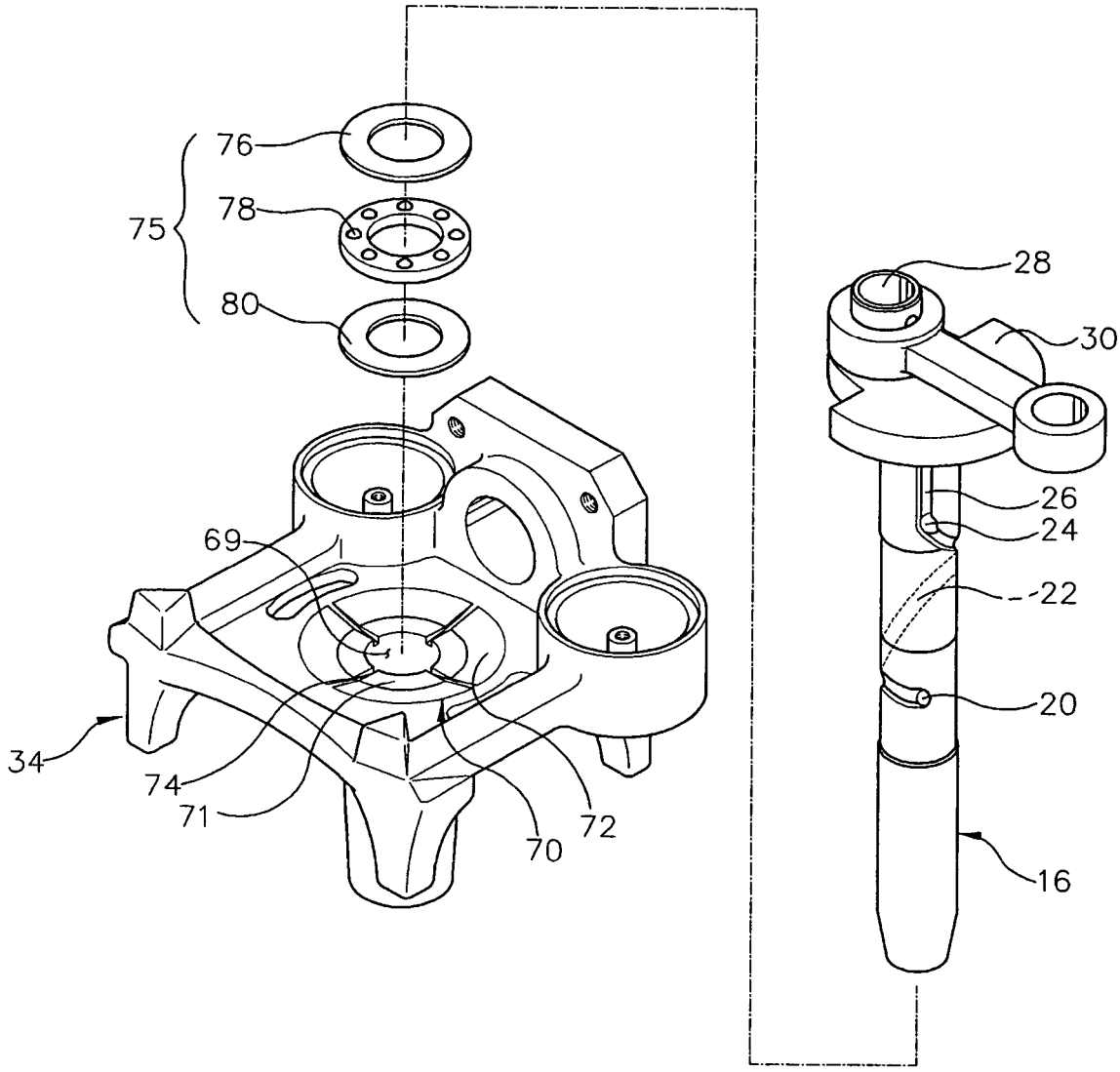
FIG. 6 is an exploded perspective view showing the coupling structure of the crankshaft and a frame having a recessed thrust portion consistent with the present invention.

Referring to FIG. 6, alternative configuration of the frame consistent with the present invention is illustrated. In this alternative configuration, differently from the configuration as shown in FIGS. 4 and 5, the frame 34 has a thrust portion 70, which is recessed rather than be protruded. The recessed thrust portion 70 has a flat portion 71 to support a thrust bearing 75 seated thereon, and an inclined portion 72 formed along a circumference of the flat portion 71 and having a diameter larger than the flat portion 71. A plurality of discharge guiding grooves 74 is formed throughout the flat portion 71 and the inclined portion 72 to extend from a hollow portion 69 of the frame 34 to an outer circumference of the inclined portion 72.

The crankshaft 16, formed with the impurities discharge passage 26, is inserted through the thrust bearing 75. The thrust bearing 75 includes an upper wheel 76, a ball 78, and a lower wheel 80. After the crankshaft 16 is penetrated through the hollow portion 69 of the frame 34, the thrust bearing 75 is seated on the flat portion 71 of the frame 34, allowing the crankshaft 16 to be supported by the frame 34.

In this case, the discharge guiding grooves 74 of the frame 34 are located underneath the lower wheel 80 of the thrust bearing 75 to be positioned about the impurities discharge passage 26 formed at the outer circumferential surface of the crankshaft 16 below the balance weight 30. Thereby, as the crankshaft 16 rotates, the impurities, having passed through the impurities discharge passage 26, are dispersed into the discharge guiding grooves 74 of the frame 34, thereby being discharged out of the thrust portion 70 by a continuous oil pumping force.

Figure 7:
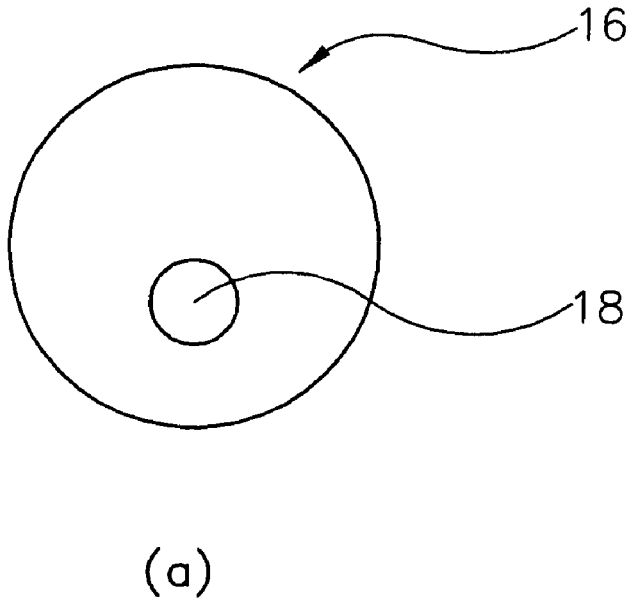
FIG. 7 (prior art)
FIG. 7*a* is a cross sectional view of a conventional crank shaft.
FIG. 7*b* is a cross sectional view of the crank shaft having the impurities discharge passage consistent with the present invention.
Figure 7:
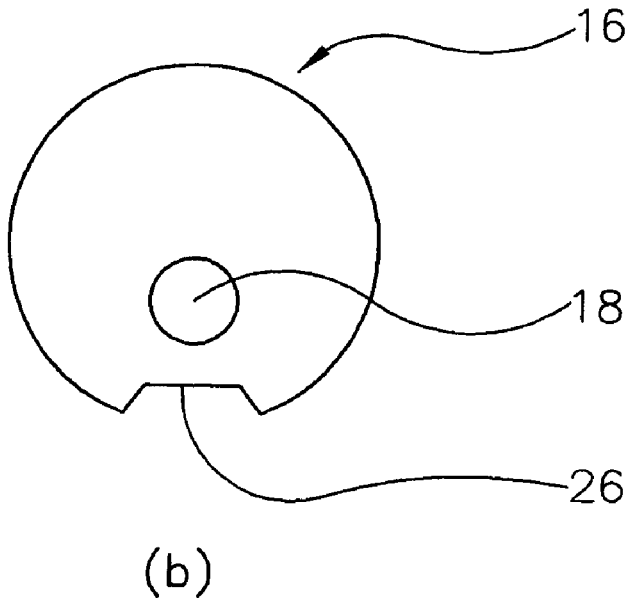
FIG. 7 (prior art)

FIGS. 7*a* and 7*b* illustrate the cross section of the crankshaft 16. Referring first to FIG. 7*a*, the crankshaft 16 has only internal passage 18 without the impurities discharge passage 26.

Referring next to FIG. 7*b*, the impurities discharge passage 26, formed at the crankshaft 16, has a conical frustum shape wherein an outer portion is wider than an inner portion. This configuration is effective to rapidly and smoothly discharge the impurities out of the impurities discharge passage 26 without clogging the passage 26.

Figure 8:
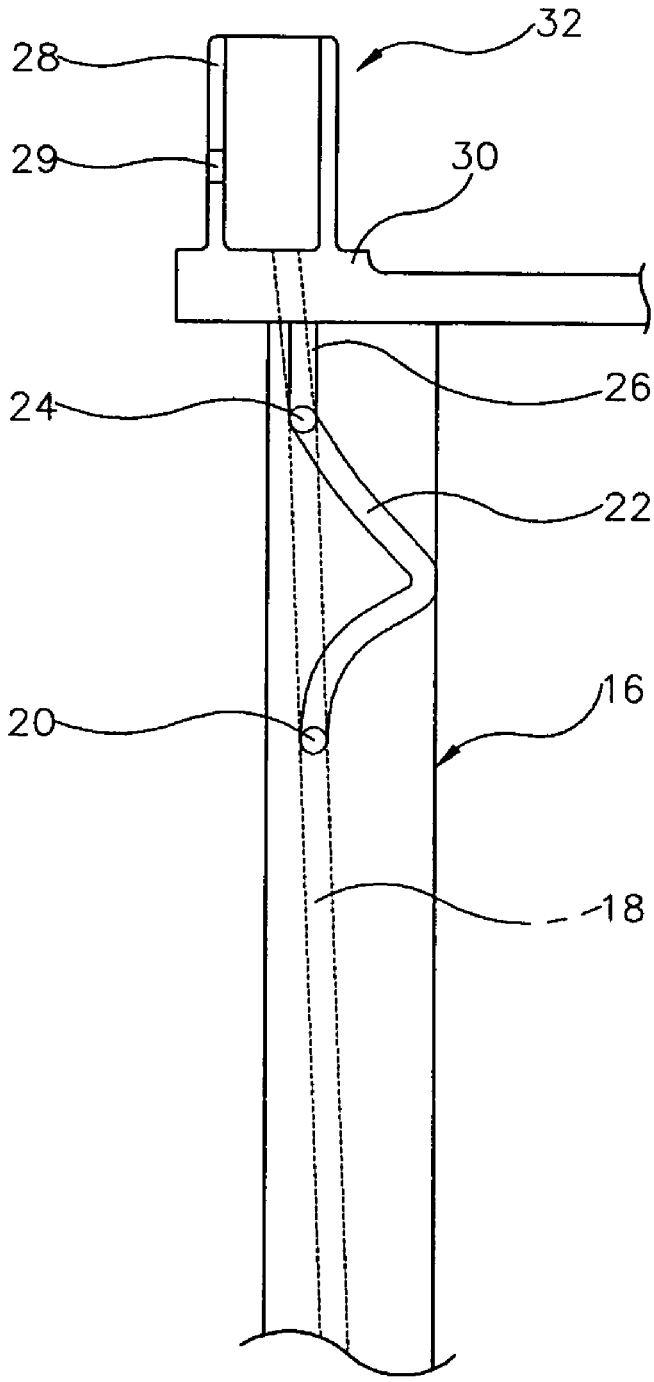
FIG. 8 is a side sectional view of the crank shaft consistent with the present invention.

FIG. 8 illustrates the impurities discharge passage 26 in greater detail. As shown in FIG. 8, the impurities discharge passage 26 of the crankshaft 16 vertically extends from the oil hole 24, located on the end of the external passage 22 formed at the outer circumferential surface of the crankshaft 16, to a lower end of the balance weight 30 of the eccentric unit 32.

Now, the operation and effects of the hermetic compressor consistent with the present invention will be explained.

Figure 9:
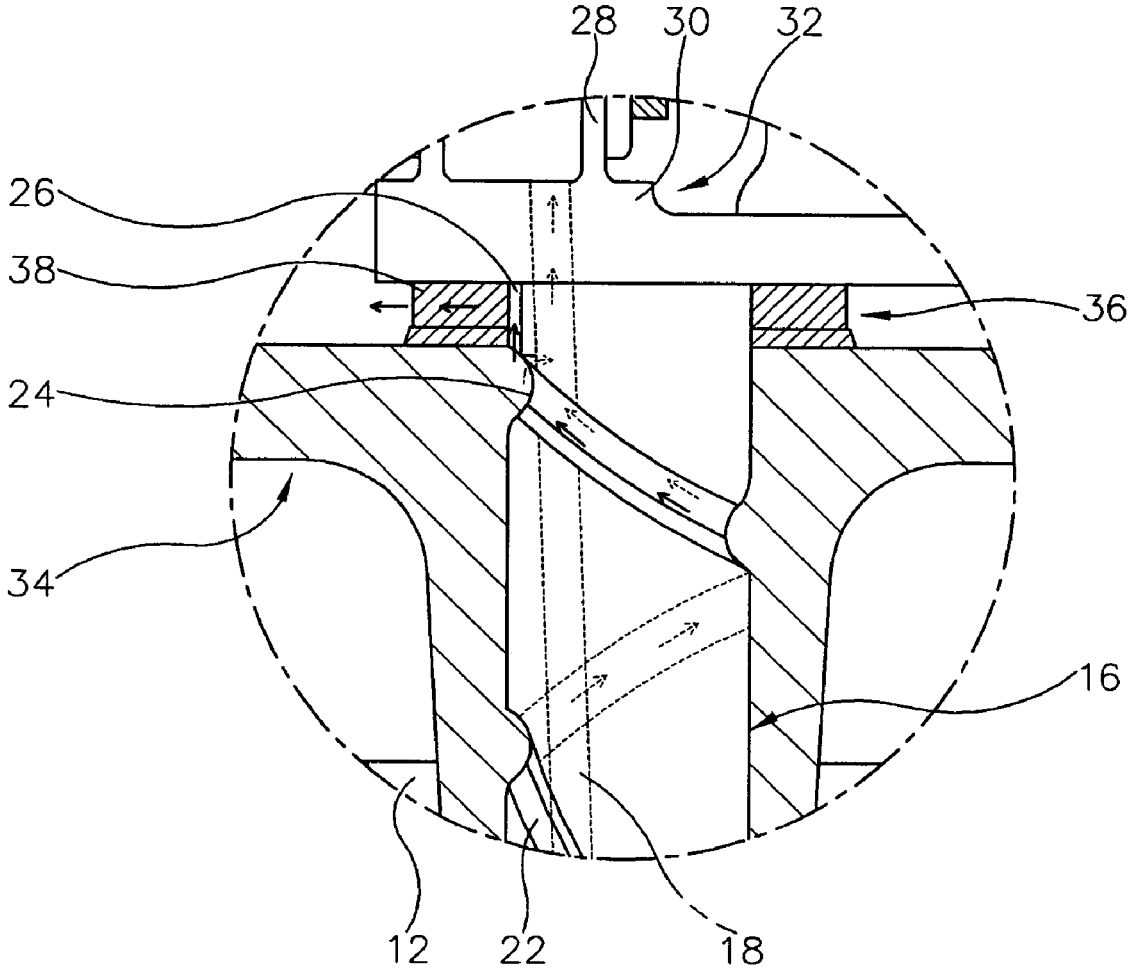
FIG. 9 is an enlarged side sectional view showing circle A of FIG. 3.

FIG. 9 illustrates the flow of oil in circle "A" of FIG. 3. As shown in FIG. 3, when the rotor 12 rotates via electromagnetic interaction with the stator (not shown), the crankshaft 16, inserted in the rotor 12, rotates in the same direction as the rotor 12. Using s centrifugal force generated upon the rotating motion of the crankshaft 16, the oil stored below the crankshaft 16 is raised through the internal passage 18 of the crankshaft 16. In this case, part of the oil is raised in the rotating direction of the crankshaft 16 along the external passage 22 in communication with the internal passage 18, while the remaining part of the oil is continuously raised through the internal passage 18 to reach the eccentric shaft 28 of the eccentric unit 32.

In the case of the oil raised along the external passage 22, it partially again enters the internal passage 18 through the oil hole 24 penetrated through the internal passage 18, while the remaining part thereof flows into the impurities discharge passage 26 located above the oil hole 24.

In general, the oil contains impurities, for example, floating matter, such as dust and chips created during the manufacture of the crankshaft, etc., or upon welding. Therefore, along with the oil, the impurities are raised through the internal passage 18 or the external passage 22.

In operation, the oil, raised through the internal passage 18, is dispersed after reaching a hollow portion of the eccentric shaft 28, thereby serving to lubricate and cool the interior of the compressor. Also, when the impurities are raised along the external passage 22 along with the oil, and reach the impurities discharge passage 26, the impurities are able to be discharged out of the thrust portion 36 of the frame 34, rather than being trapped between the frame 34 and the crankshaft 16, under the guidance of the discharge guiding grooves 38, which are formed at the thrust portion 36. Here, the discharge guiding grooves 38 are radially and outwardly positioned about the impurities discharge passage 26.

After that, the oil and the impurities flow down the frame 34, thereby serving to lubricate and cool the interior of the compressor.

In summary, by virtue of the impurities discharge passage 26 and the impurities guiding grooves 38 formed at both the crankshaft 16 and the thrust portion 36 of the frame 34, there is no risk that the impurities, mixed with the oil, are trapped between the thrust portion 36 of the frame 34 and the outer circumferential surface of the crankshaft 16. Thus, unintentional stoppage in the rotating motion of the crankshaft 16 can be effectively prevented.

As is apparent from the above description, the present invention provides a hermetic compressor wherein a crankshaft has an impurities discharge passage, and, correspondingly, a crankshaft supporting frame has a plurality of discharge guiding grooves formed at a thrust portion thereof, allowing impurities, having passed through the impurities discharge passage, to flow under the guidance of the impurities guiding grooves formed at the thrust portion. This has the effect of preventing the impurities from being trapped between the crankshaft and the thrust portion of the frame, and smoothly discharging the impurities out of the crankshaft and the thrust portion, along with oil.

As a result, the present invention can prevent sudden stoppage in a rotating motion of the crankshaft due to the impurities, ensuring more efficient operation of the compressor.

Although exemplary embodiments of the present invention have been shown and described, it will be appreciated by those skilled in the art that changes may be made in this embodiment without departing from the principles and spirit of the invention, the scope of which is defined in the claims and their equivalents.

What is claimed is:

1. A hermetic compressor comprising a frame having a hollow portion, a crankshaft rotatably inserted in the hollow portion, and a thrust portion formed at the frame to support the crankshaft, further comprising:

an impurities discharge passage formed at an outer circumferential surface of the crankshaft adjacent to the thrust portion of the frame and adapted to guide oil and impurities mixed with the oil out of the crankshaft; and a plurality of discharge guiding grooves formed at the thrust portion of the frame at specific positions corresponding to the impurities discharge passage, and adapted to guide the oil and the impurities, having passed through the impurities discharge passage, out of the thrust portions, wherein: the crankshaft includes a plurality of oil holes for the entrance and exit of the oil into or from the crankshaft, and an external passage to connect the oil holes to one another; and the impurities discharge passage is separately formed with the external passage and extends along the outer circumferential surface of the crankshaft starting from one of the plurality of oil holes to an end of the crankshaft.

2. The compressor according to claim 1, wherein: the end of the crankshaft is provided with a balance weight to balance the crankshaft when the crankshaft rotates; and the impurities discharge passage extends from one of the plurality of oil holes closest to the balance weight to a portion of the crankshaft connected to the balance weight.

3. The compressor according to claim 2, wherein the impurities discharge passage is formed in a straight line extending from the oil hole closest to the balance weight to the portion of the crankshaft connected to the balance weight.

4. The compressor according to claim 3, wherein a horizontal cross section of the impurities discharge passage has a conical frustum shape wherein an outer portion is wider than an inner portion.

5. The compressor according to claim 2, wherein the impurities discharge passage has a spiral shape extending in a rotating direction of the crankshaft from the oil hole closest to the balance weight to an underside of the balance weight.

6. The compressor according to claim 1, wherein: the thrust portion of the frame has an annular shape and is protruded from a surface of the frame; and the discharge guiding grooves of the thrust portion extend from the hollow portion to an outer circumference of the thrust portion.

7. The compressor according to claim 6, wherein the plurality of discharge guiding grooves, formed at the thrust portion, are spaced apart from one another.

8. The compressor according to claim 7, wherein each of the discharge guiding grooves of the thrust portion has a straight line form radially extending from the hollow portion to the outer circumference of the thrust portion.

9. The compressor according to claim 7, wherein each of the discharge guiding grooves of the thrust portion has a width equal to or larger than a width of the impurities discharge passage formed at the crankshaft to ensure smooth discharge of the impurities and the oil.

10. The compressor according to claim 1, wherein: a thrust bearing is seated between the thrust portion of the frame and the crankshaft to support the crankshaft while facilitating a rotating motion of the crankshaft;

the thrust portion of the frame has an annular shape and is recessed from a surface of the frame by a predetermined depth to allow the thrust bearing to be seated thereon; and the discharge guiding grooves of the thrust portion extend from the hollow portion to an outer circumference of the thrust portion.

11. A hermetic compressor comprising a frame having a hollow portion, a crankshaft rotatably inserted in the hollow portion, and a thrust portion formed at the frame to support the crankshaft, further comprising:

an impurities discharge passage formed at an outer circumferential surface of the crankshaft adjacent to the thrust portion of the frame and adapted to guide oil and impurities mixed with the oil out of the crankshaft;

a plurality of discharge guiding grooves formed at the thrust portion of the frame at specific positions corresponding to the impurities discharge passage, and adapted to guide the oil and the impurities, having passed through the impurities discharge passage, out of the thrust portion; and a thrust bearing seated between the thrust portion of the frame and the crankshaft to support the crankshaft while facilitating a rotating motion of the crankshaft;

wherein, the thrust portion of the frame having an annular shape and being recessed from a surface of the frame by a predetermined depth to allow the thrust bearing to be seated thereon; and the discharge guiding grooves of the thrust portion extending from the hollow portion to an outer circumference of the thrust portion.

* * * * *